United States Patent [19]

Fujii et al.

[11] 4,238,175

[45] Dec. 9, 1980

[54] MELT BLOWING APPARATUS

[75] Inventors: Shigeo Fujii; Tokuzo Ikeda; Takashi Mikami; Shuji Okano, all of Ooi, Japan

[73] Assignee: Toa Nenryo Kogyo Kabushiki Kaisha, Tokyo, Japan

[21] Appl. No.: 882,596

[22] Filed: Mar. 2, 1978

[30] Foreign Application Priority Data

Mar. 15, 1977 [JP] Japan ..... 52-27659

[51] Int. Cl.[3] ..... B28B 5/00

[52] U.S. Cl. ..... 425/83.1; 156/167; 264/176 F; 264/DIG. 75

[58] Field of Search ..... 156/181, 167; 425/7, 425/83.1; 264/176 F, DIG. 75

[56] References Cited

U.S. PATENT DOCUMENTS

| | | | |
|---|---|---|---|
| 2,577,214 | 12/1951 | Slayter | 156/181 |
| 2,732,885 | 1/1956 | Hoven | 65/4 R |
| 2,801,673 | 8/1957 | Welsh | 65/4 R |
| 2,897,874 | 8/1959 | Stalego et al. | 65/4 R |
| 3,032,456 | 5/1962 | Wade | 264/DIG. 75 |
| 3,096,225 | 7/1963 | Carr et al. | 156/181 |
| 3,110,642 | 11/1963 | Harrington et al. | 156/181 |
| 3,595,245 | 7/1971 | Buntin et al. | 264/DIG. 75 |
| 3,705,068 | 12/1972 | Dobo et al. | 156/181 |
| 3,775,209 | 11/1973 | Paquette et al. | 156/181 |
| 3,775,210 | 11/1973 | Paquette et al. | 156/181 |
| 3,933,557 | 1/1976 | Pall | 156/181 |
| 4,091,140 | 5/1978 | Harmon | 156/181 |
| 4,095,312 | 6/1978 | Haley | 264/210 F |

*Primary Examiner*—Jay H. Woo
*Attorney, Agent, or Firm*—W. T. Clarke; M. B. Kurtzman

[57] ABSTRACT

A process and apparatus are provided for the production of a non-woven fabric by melt-blowing wherein one or more yarns, e.g. monofilaments, are added or charged into the fabric stream between the extruder and collector by means of a supporting and drawing pressure gas stream. In one embodiment means are provided to regulate flow of the gas stream in another embodiment means are provided to reciprocate or to rotate through a small arc the one or more charging means.

3 Claims, 8 Drawing Figures

MELT BLOWING APPARATUS

BACKGROUND OF THE INVENTION

1. Field of the Invention

This invention relates to an apparatus and process for the production of a non-woven structure formed from thermoplastic resin fine fibers and yarns.

2. Discussion of Prior Arts

Non-woven fabrics or theromplastic resins (which will hereinafter be referred to as "webs" have hitherto been produced by the melt blowing methods, in which a thermoplastic resin is extruded from small holes to form fibers, blown against a collection screen by a hot gas and thus collected, and have widely been used in various fields. Such a web, in particular, composed of fine fibers has been used for special uses because of its eminently suitable characteristics, but has the disadvantage that the mechanical properties of the web such as tensile strength, bending stiffness, etc. are low because the fibers have extremely small diameters and are not stretched; or if the fibers are stretched, the degree of stretching is not sufficient and accordingly, the uses of the web must be limited.

In order to overcome this disadvantage, there have been proposed methods for increasing the strength of a web by increasing its integrity, for example, by binding or fixing warps or wefts to one side or both sides of the web or into the web with adhesives or through thermal fusion. These methods, however, are all complicated; further due to the adhesives used the methods limit application of the web.

An object of the present invention is to provide a web wherein the above described problems are eliminated.

SUMMARY OF THE INVENTION

In accordance with this invention a non-woven fabric of superior strength is attained by feeding or charging a yarn, e.g. a monofilament into a non-woven fabric or web during production thereof and forming the web and yarn into a unitary body.

That is to say, the present invention comprises (1) a process for the production of a non-woven structure, which comprises blowing a high speed hot gas against a melted thermoplastic resin to form a fiber stream comprising fine thermoplastic resin fibers of 0.5 to 50 microns in fiber diameter and collecting the fiber stream while feeding at least one continuous yarn having a size of 1 to 600 denier to the fiber stream by a high speed gas, and (2) an apparatus for the production of a non-woven structure, which comprises, a means for extruding a thermoplastic resin to form fine fibers and blowing the fibers to form a fiber stream comprising fine thermoplastic resin fibers, means for collecting the fiber stream, said means being spaced apart from the thermoplastic resin blowing means and a means for feeding a yarn, into the fiber stream by a high speed gas, said feeding means being arranged between the thermoplastic resin blowing means and fiber stream collecting means.

DETAILED DESCRIPTION OF THE INVENTION

The web of the present invention is composed of extremely fine fibers of a thermoplastic resin having a fiber diameter of 0.5 to 50 microns, obtained by the melt blowing method. Useful examples of the thermoplastic resin are polyolefins such as polyethylene and polypropylene, polyamides, polyesters, polyvinyl chloride, polycarbonates, polyurethanes and the like. Modified polyolefins obtained by grafting unsaturated carboxylic acids to polyolefins lacking in adhesiveness can be used so as to increase the adhesvieness to yarns.

As the yarn of the present invention, any vegetable, mineral and synthetic resin materials can be used having a size of about 1 to about 600 denier. Yarns of synthetic resins, in particular, thermoplastic resins are preferred, which may be most preferably stretched; any spun yarns or filament yards can be used. The same kinds of thermoplastic resins may be used for the yarn as those used as a starting material for the web; the particular thermoplastic resins used for the web and yarn may be the same or different.

The present invention provides a process for the production of a non-woven structure, wherein during production of a web by the melt blowing method, at least one yarn which may be continuous is fed by a high speed gas into a high speed fiber stream comprising extremely fine fibers of a thermoplastic resin extruded from a die and blown by a hot gas against a collecting screen and then fibers and yarns are collected on the collecting screen.

DETAILED DESCRIPTION OF THE DRAWINGS

Figure 1:
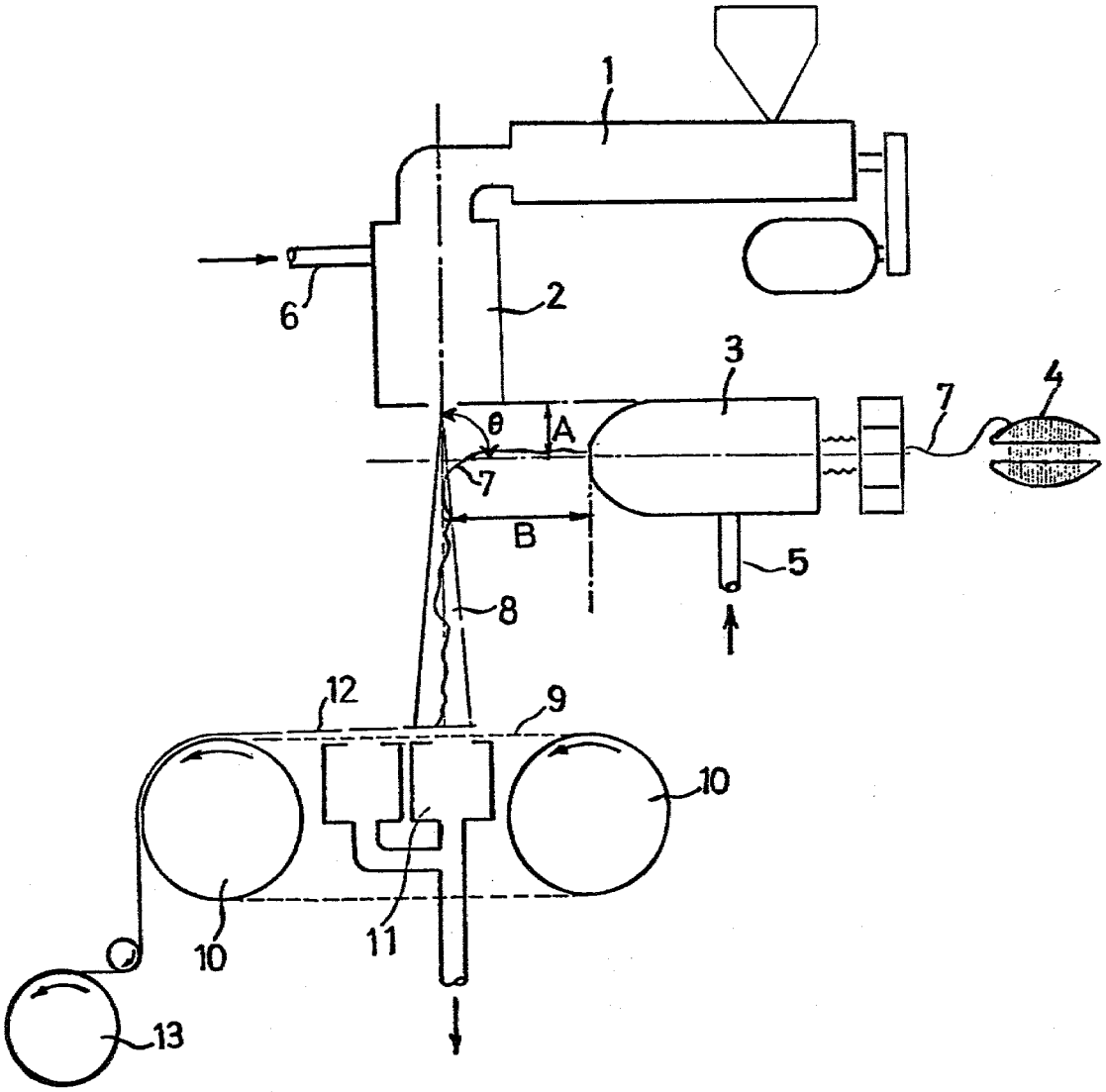
FIG. 1 is a schematic view of the apparatus according to the present invention.

Referring to FIG. 1, a thermoplastic resin is melted and extruded by means of an extruder 1 to a die means 2 (not shown specifically) and then injected therefrom with a hot gas, preferably heated air, supplied from a gas pipe 6 to form a high speed fiber stream 8. At the same time, a yarn 7 is drawn from a yarn feeding means 3 by a pressure gas supplied from a pipe 5 and fed into the fiber stream 8. A non-woven structure (12) formed in this way is collected on a flexible collecting screen 9 which is driven by one of the rolls 10, and then taken up by a product roll 13.

As shown in FIG. 1 collection of the non-woven structure 12 on the screen 9 is aided by the suction box 11 which applies gentle suction to the screen thereby drawing the non-woven structure 12 onto it.

The space relation of the die 2 and yarn feeding means 3 depends on the conditions of the web-producing process and the intended use of the non-woven structure product, but is preferably such that, as shown in FIG. 1, the distance A is 5 to 300 mm and the distance between the yarn feeding means 3 and fiber stream 8 (Distance B FIG. 1) is 10 to 1000 mm. Furthermore, the charging angle of the yarn 7 in the fiber stream 8 ($\theta$ (theta) FIG. 1) is generally, 30 degrees to 140 degrees, preferably 50 degrees to 110 degrees ($\theta$ equals 90 degrees in FIG. 1). The charging speed of the yarn 7 in the fiber stream 8 depends on the speed of the fiber stream, but ordinarily is 30 to 400 m/sec, which can be controlled by changing the pressure of the pressurized gas, preferably compressed air, supplied to the yarn charging means 3.

In the present invention, at least one continuous yarn is fed to a fiber stream, but if the system is so constituted that charging of the yarn into the fiber stream 8 is carried out at only one position, the yarn may be one-sided in the fiber stream, resulting in an uneven non-woven structure. Therefore, it is desirable to provide a plurality of yarn charging means or to install yarn charging means which may reciprocate or may rotate through a small angle, thereby charging the yarn evenly in the fiber stream and raising the strength of the resulting non-woven structure evenly. The detail of the yarn charging means will be illustrated hereinafter.

In accordance with the present invention, it is important to add the yarn 7 into the fiber stream 8 without disturbing the fiber stream 8, and this can effectively be accomplished by using a small quantity of air when using the yarn charging means 3 having the structure described below.

Figure 2:
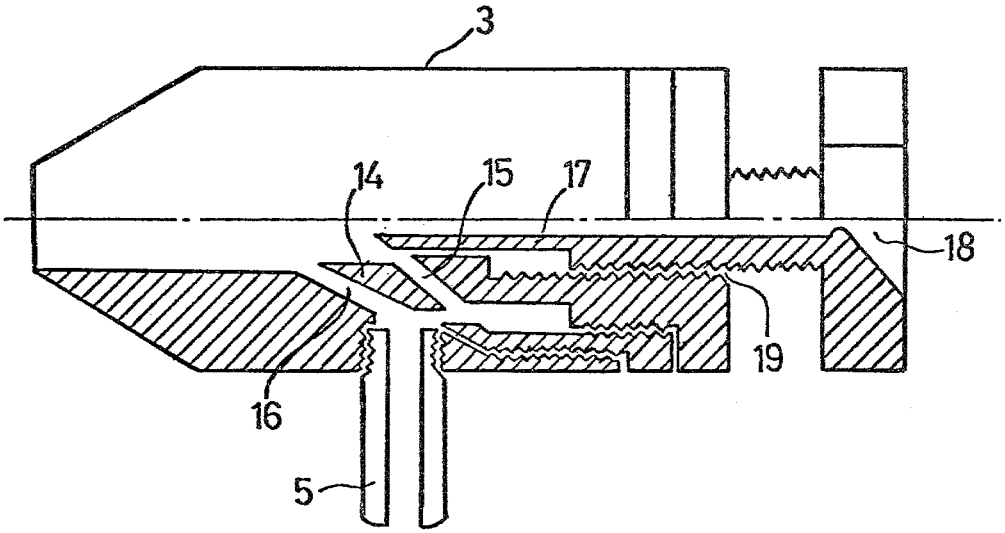
FIG. 2 is a side view, partially in cross section, of the yarn charging means in the apparatus of the present invention.
Figure 3:
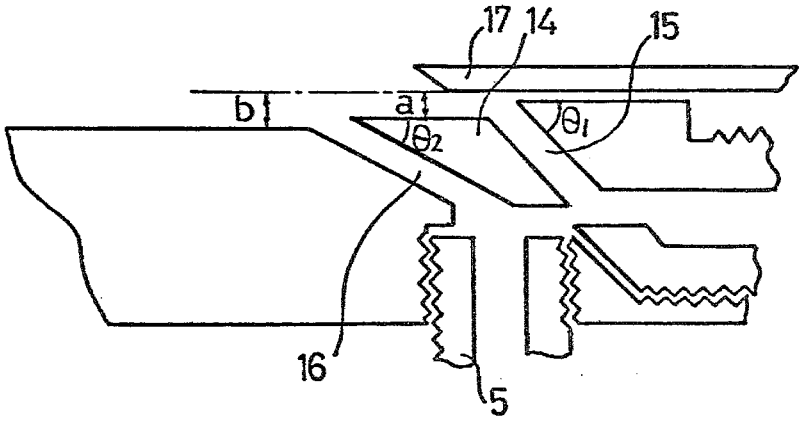
FIG. 3 is a partially enlarged view of FIG. 2.

As shown in FIG. 2, the yarn charging means of the present invention is provided inside with a yarn path 18 and two air paths 15 and 16 separated by a spacer 14, to which a pipe 5 for feeding a pressurized gas is connected. In FIG. 3, the air paths 15 and 16 are separated (by spacer 14) by an interval of 0.3 to 1 mm, preferably 0.4 to 0.6 mm and the angles $\theta_1$ ($\theta$ (theta) and $\theta_2$ ($\theta$ (theta) to the yarn path 18 are adjusted so as to satisfy the relation of $\theta_1 > \theta_2$. In this case, $\theta_1$ is generally 30 to 70 degrees, preferably 40 to 50 degrees and $\theta_2$ is generally 20 to 40 degrees, preferably 25 to 35 degrees. These air paths 15 and 16 are turned in the downstream courses so as to have spaces a and b in parallel to the yarn path 18. The space a is generally 0.5 mm to 3 mm, preferably 0.7 to 1.5 mm and the space b is generally 1 to 5 mm, preferably 1.5 to 2.5 mm, the space being larger than the space a.

In the interior of the yarn charging means 3, moreover, there is provided a nozzle regulator 17 to regulate the flowing direction and speed of air to the yarn 7 at the outlet of the air paths 15 and 16, the nozzle regulator being optionally moved back and forth by a screw 19.

Figure 2A:
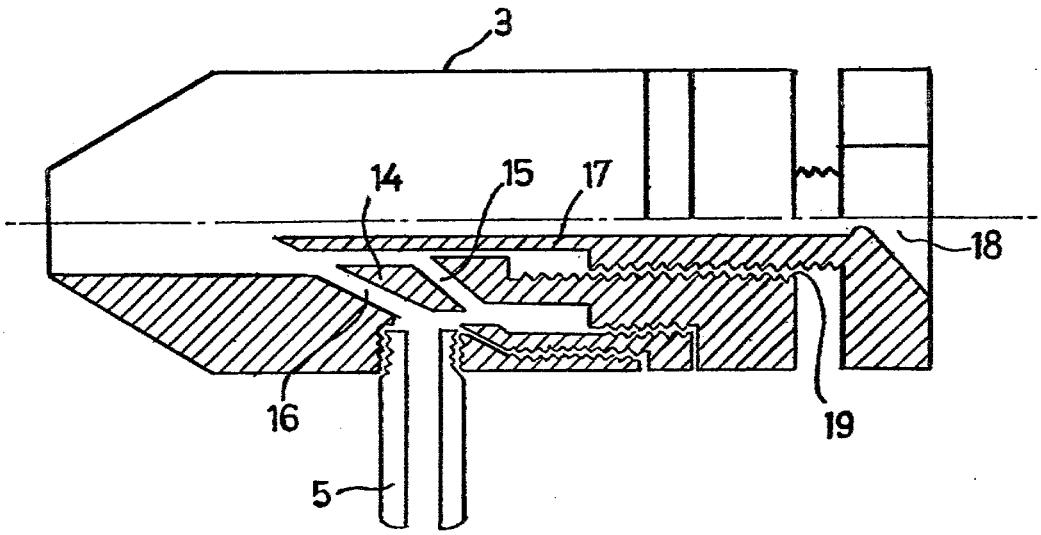
FIG. 2A is the same as FIG. 2 but with the regulator 17 moved to the left.

As explained above, the nozzle regulator 17 can be moved back and forth, and thereby the charge speed of yarn 7 can be regulated. The yarn charging means having inside two varying air paths for feeding air, provides an air stream in the yarn charging means which is faster than that provided in other charging means having one air path, and as a result the yarn can be drawn strongly by a relatively small quantity of air. If the regulator 17 is withdrawn all the way to the right so that it does not affect air paths 15 and 16, the yarn cannot be drawn out. But as it is moved to the left, the yarn can be pulled out, and charged into the fiber stream. When the position of the sharp end of regulator 17 is as shown in FIG. 2A, the yarn may be drawn most strongly.

The yarn charging means 3 of the present invention has the above described structure as one embodiment and can have further modifications as shown in FIGS. 4 to 7.

Figure 4:
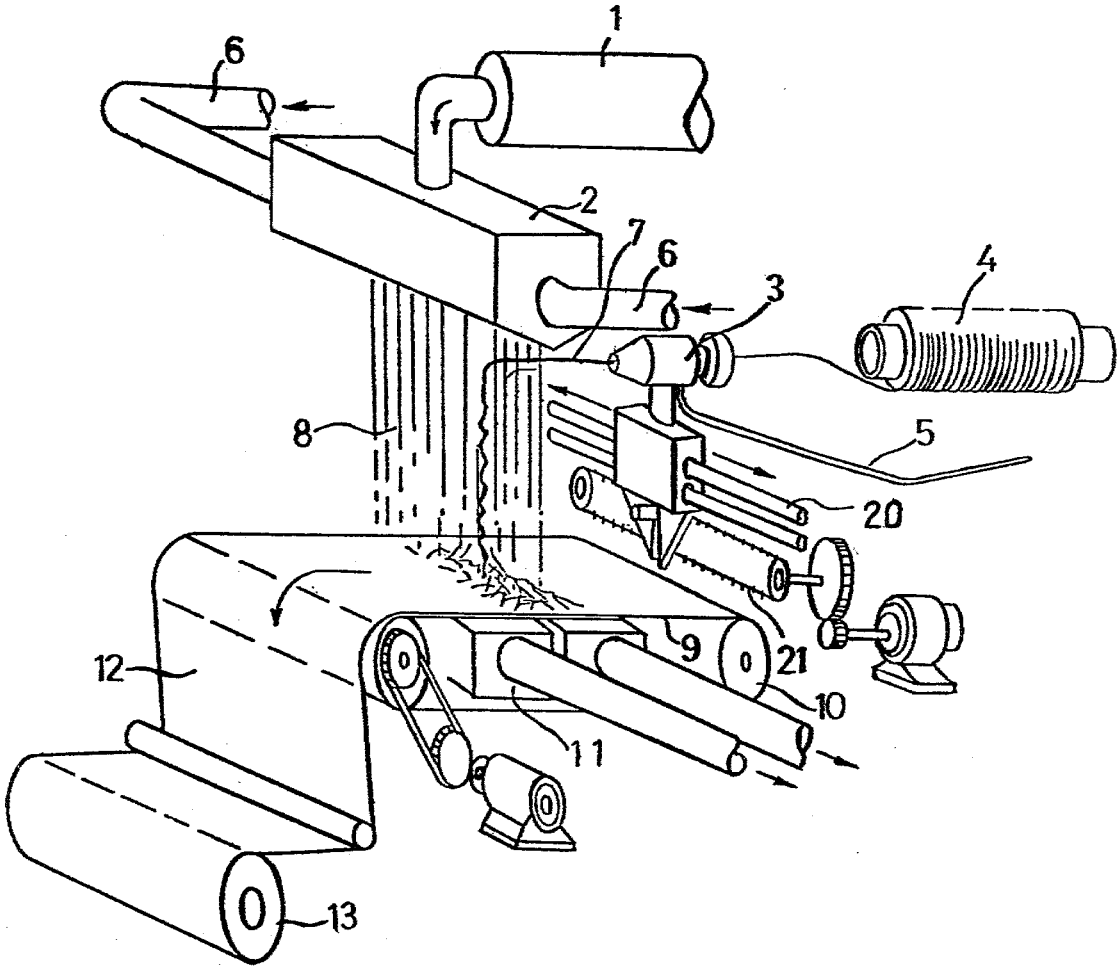
FIG. 4 is a perspective view of the apparatus according to the present invention.
Figure 5:
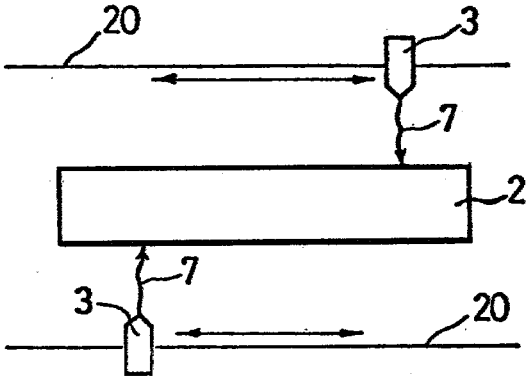
FIG. 5, FIG. 6 and FIG. 7 are respectively plan views of the thermoplastic resin blowing means and yarn charging means designed to show the method of charging yarns according to the present invention.
Figure 6:
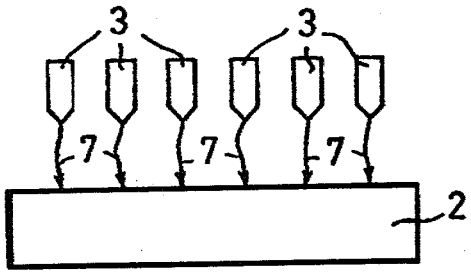

In FIG. 4 and FIG. 5, the yarn charging means 3 is subjected to reciprocating motion perpendicular to the longitudinal direction of the fiber stream 8. Thus, in FIG. 4 the yarn charging means 3 is reciprocated along the arms 20 by means of the chain 21. In FIG. 5 the yarn charging means 3 is reciprocated along the arms 20 by means not shown. In FIG. 6 a number of yarn charging means 3 are provided; and in FIG. 7, each yarn charging means 3 is rotatable through a small angle to right and left perpendicular to the direction of the fiber stream. In these embodiments, a yarn or yarns can be charged uniformly into a fiber stream and, accordingly, the properties of the resulting non-woven fabric structure obtained in this way can be made uniform.

The non-woven structure of the present invention can be produced in an easy and effective manner, in particular, by the use of the apparatus of the invention. The proportion of web and yarn in such a non-woven structure, depending upon the use thereof, is in such a range that the strength of the web is increased to a required level for the object of the present invention, that is, ordinarily 1 to 5 parts by weight of yarn to 100 parts by weight of web, since if the proportion of yarn is too much, the characteristics of the web as a non-woven fabric are diminished.

The non-woven structure obtained by the process of the present invention has not only a greater strength but also a better hand than prior art webs and, in addition, it can be applied to various uses, for example, filters, synthetic leather, building materials, electric materials, medical materials, etc.

The following examples are offered by way of illustration.

EXAMPLE 1

As shown in FIG. 4, a polypropylene heated and melted at 310° C. was extruded from the die 2 and blown by heated air at 320° C. to form a fiber stream comprising extremely fine fibers of polypropylene. While subjecting the yarn charging means 3 to reciprocating motion, a stretched nylon-6 yarn (monofilament) with a size of 6 to 8 denier was drawn by heated air at 80° C., charged into the fiber stream at a speed of 60 m/sec and collected on a collecting plate 9 to obtain a non-woven structure 12 with a thickness of 1.5 mm. For this example the distances and angles in FIG. 1 and FIG. 3 had the following values;

A=50 mm, B=350 mm, $\theta$=80 degrees, Space 15=0.5 mm, Space 16=0.5 mm, a=0.7 mm, b=1.5 mm, $\theta_1$=40 degrees, $\theta_2$=25 degrees.

The non-woven structure obtained by this method consisted of 98% by weight of a web of polypropylene with a fiber diameter of 7 microns and 2% by weight of a nylon-6 yarn as described above, and had a basis weight of 180 g/m$^2$. The properties as described in the following, were superior to those of a similar web, produced without the addition of the nylon-6 yarn. In particular when used as a synthetic leather of filter, the performance was improved.

| | Non-woven Structure | Web |
|---|---|---|
| Tensile Strength (ASTM D 1628) | | |
| MD (Kg/25 mm) | 6.2 | 4.7 |
| CD (Kg/25 mm) | 5.8 | 4.5 |
| Tear Strength (ASTM D 2261) | | |
| MD (Kg) | 0.50 | 0.29 |

EXAMPLE 2

Figure 7:
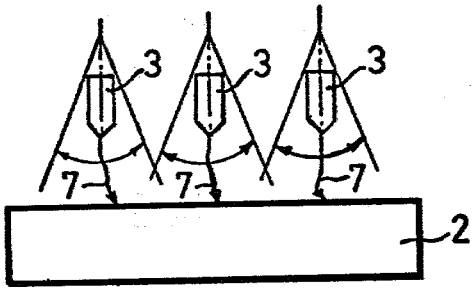

A mixture of 4 parts by weight of modified polypropylene obtained by grafting endo-bis-bicyclo (2,2,1)-5-heptene-2,3-dicarboxylic anhydride to polypropylene and 6 parts by weight of polypropylene was heated and melted at 310° C., extruded from the die 2 and blown with heated air at 320° C. to form a fiber stream. While the yarn charging means 3 was subjected to a shaking motion as shown in FIG. 7, a stretched polypropylene yarn (monofilament) with a size of 8 denier was drawn by heated air at 90° C., charged in the fiber stream at a speed of 70 m/sec and collected on the collecting plate 9 to obtain a non-woven structure having a thickness of 1.7 mm. For this example the distances and angles in FIG. 1 and FIG. 3 had the following values:

A=70 mm, B=250 mm $\theta$=70 degrees, Space 15=0.5 mm, Space 16=0.5 mm, a=0.7 mm, b=1.5 mm, $\theta_1$=40 degrees, $\theta_2$=25 degrees.

The non-woven structure obtained by this method consisted of 98% by weight of the polypropylene mixture with a fiber diameter of 8 microns and 4% by weight of the above-described polypropylene yarn and had a basis weight of 200 g/m$^2$. Properties as described in the following, were superior to those of a similar web produced without the addition of the polypropylene yarn. In particular, the web showed superior performances when used as synthetic leather, filters, separators for lead batteries and alkaline batteries.

| | Nonwoven Structure | Web |
|---|---|---|
| Tensile Strength (ASTM D 1682) | | |
| MD (Kg/25mm) | 6.7 | 5.0 |
| CD (Kg/25mm) | 6.3 | 4.7 |
| Tear Strength (ASTM D 2261) | | |
| MD (kg) | 0.60 | 0.31 |

What we claim is:

1. An apparatus for the production of a non-woven structure, which comprises means for blowing a thermoplastic resin to form a fiber stream consisting of fine thermoplastic resin fibers with a hot gas, means for collecting the fiber stream arranged apart from the thermoplastic resin blowing means, and spaced apart from the fiber stream a distance from about 10 to about 1000 mm means having a yarn path, two gas paths at varying angles to the yarn path and movable spacer means for changing the angles of the gas passing through the gas path for charging a continuous yarn at a rate of 30 to 40 m/sec. and at an angle of about 30 degrees to about 140 degrees uniformly into the fiber stream by a high speed gas arranged between the thermoplastic resin blowing means and fiber stream collecting means, the distance between the thermoplastic resin blowing means and the means for charging the yarn being about 5 to about 300 mm.

2. The apparatus as claimed in claim 1, wherein the yarn charging means is supported in a movable manner to reciprocate in a direction perpendicular to the direction of the fiber stream.

3. The apparatus as claimed in claim 2, wherein the yarn charging means is so installed as to rotate back and forth through a small arc in a plane perpendicular to the direction of the fiber stream.

* * * * *